US009288593B2

(12) United States Patent
Boretzki

(10) Patent No.: US 9,288,593 B2
(45) Date of Patent: Mar. 15, 2016

(54) VISUALLY-BASED FITTING OF HEARING DEVICES

(75) Inventor: Michael Boretzki, Ruti (CH)

(73) Assignee: SONOVA AG, Staefa (CH)

( * ) Notice: Subject to any disclaimer, the term of this patent is extended or adjusted under 35 U.S.C. 154(b) by 364 days.

(21) Appl. No.: 13/811,022

(22) PCT Filed: Jul. 19, 2010

(86) PCT No.: PCT/EP2010/060447
§ 371 (c)(1),
(2), (4) Date: Jan. 18, 2013

(87) PCT Pub. No.: WO2012/010199
PCT Pub. Date: Jan. 26, 2012

(65) Prior Publication Data

US 2013/0121496 A1 May 16, 2013

(51) Int. Cl.
*H04R 29/00* (2006.01)
*H04R 25/00* (2006.01)

(52) U.S. Cl.
CPC ..... *H04R 25/70* (2013.01); *H04R 2225/81* (2013.01); *H04R 2225/83* (2013.01)

(58) Field of Classification Search
CPC .. H04R 25/70; H04R 25/558; H04R 2225/81; H04R 2225/83
USPC ..... 381/60, 312, 23.1
See application file for complete search history.

(56) References Cited

U.S. PATENT DOCUMENTS 5,137,345 A * 8/1992 Waldorf ..... A61B 3/113 351/206
2003/0099370 A1 5/2003 Moore
2007/0076909 A1* 4/2007 Roeck ..... H04R 25/70 381/312
2009/0285456 A1* 11/2009 Moon ..... G06K 9/00315 382/118
2010/0076339 A1* 3/2010 Marcoux ..... A61B 5/04845 600/559
2012/0259385 A1* 10/2012 McElveen, Jr. .... A61N 1/36032 607/57

FOREIGN PATENT DOCUMENTS

EP 1 617 705 A2 1/2006
EP 1 703 770 A1 9/2006
WO 2010/072245 A1 7/2010

OTHER PUBLICATIONS

International Search Report for PCT/EP2010/060447 dated Mar. 4, 2011.

* cited by examiner

*Primary Examiner* — Xu Mei
*Assistant Examiner* — Ammar Hamid
(74) *Attorney, Agent, or Firm* — Pearne & Gordon LLP

(57) ABSTRACT

A method for adapting a hearing device (6, 7) to the hearing needs and preferences of an individual (U) is presented, wherein sound processing in said hearing device (6, 7) is programmable by means of adjustable parameters. The method comprises the steps of a) presenting at least one auditory test signal (1*a*) to said individual (U);
b) capturing at least one image (2*a*) of at least a portion of said individual's body;
c) analyzing said at least one image (2*a*);
d) deducing from said image analysis whether or not said individual (U) has shown a reaction upon said presenting said at least one auditory test signal (1*a*) and, if yes, which reaction said individual (U) has shown;
e) determining, in dependence of said at least one auditory test signal (1*a*) and of said reaction or lack of reaction, a setting for at least one of said adjustable parameters.

22 Claims, 1 Drawing Sheet

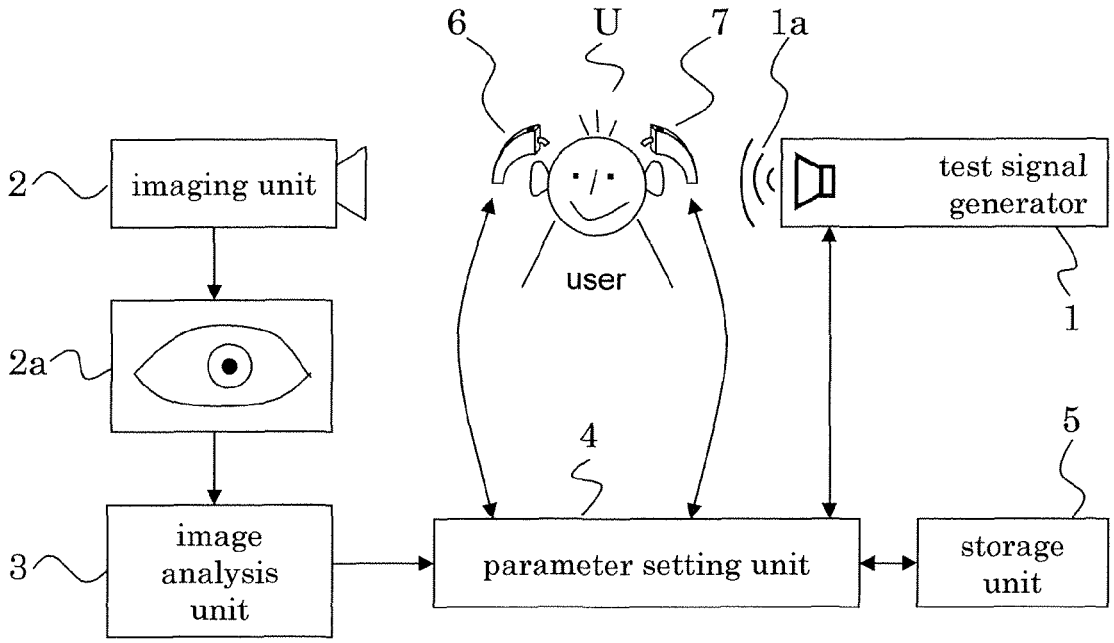
6
U
7
1a
2
imaging unit
test signal generator
user
1
2a
4
5
3
image analysis unit
parameter setting unit
storage unit

VISUALLY-BASED FITTING OF HEARING DEVICES

TECHNICAL FIELD

The invention relates to the field of hearing devices, and in particular to the fitting of hearing devices. It relates to methods and apparatuses according to the opening clauses of the claims.

Under a hearing device, a device is understood, which is worn in or adjacent to an individual's ear with the object to improve the individual's audiological perception. Such improvement may also be barring acoustic signals from being perceived in the sense of hearing protection for the individual. If the hearing device is tailored so as to improve the perception of a hearing impaired individual towards hearing perception of a normal-hearing individual, then we speak of a hearing-aid device. With respect to the application area, a hearing device may be applied, e.g., behind the ear, in the ear, completely in the ear canal or may be implanted.

A hearing system comprises at least one hearing device. In case that a hearing system comprises at least one additional device, all devices of the hearing system are operationally connectable within the hearing system. Typically, said additional devices such as another hearing device, a remote control or a remote microphone, are meant to be worn or carried by said individual.

Under audio signals we understand electrical signals, analogue and/or digital, which represent sound.

BACKGROUND OF THE INVENTION

The adapting of a hearing device to the hearing needs and preferences of an individual, also referred to as "fitting", is an important and complicated process, in particular in case of hearing-aid devices. Usually, the competence of a hearing device professional such as an audiologist is needed in order to achieve satisfactory fitting results.

But if the individual is a baby or is mentally handicapped, the normal way of carrying out the fitting is not feasible, as proper spoken responses to test signals will not be provided by the individual.

In EP 1 617 705 A2, a hearing device is disclosed which can be fitted by the individual (the hearing device user) without need of further assistance.

In US 2010/0076339 A1, a system for determining the hearing ability of an individual is disclosed. For determining the hearing capacity of an individual, it is suggested in said US 2010/0076339 A1 to connect the individual to an electrophysiological instrument, i.e. to place electrodes on the individual's head and monitor fluctuations in monitored electrical potentials, in a synchronized manner with presenting a stimulus signal to the individual.

SUMMARY OF THE INVENTION

One object of the invention is to create an alternative way of fitting a hearing device. Besides a method for adapting a hearing device to the hearing needs and preferences of an individual, also a use of such a method, a corresponding apparatus (for carrying out the method) and also a corresponding computer program product along with a corresponding computer-readable medium shall be provided.

Another object of the invention is to provide a way of fitting a hearing device which can be applied to people suffering from dementia and other mentally handicapped people.

Another object of the invention is to provide a way of fitting a hearing device which can be applied to babies and small children.

Another object of the invention is to provide a way of fitting a hearing device which can be applied by the hearing device user without or largely without help from other people, in particular from hearing device professionals.

Another object of the invention is to provide a way of fitting a hearing device which does not require to fix one or more electrodes to the individual.

Another object of the invention is to provide a way of fitting a hearing device which allows to achieve improved fitting results.

Another object of the invention is to provide a way of fitting a hearing device which can be carried out in relatively short time.

Further objects emerge from the description and embodiments below.

At least one of these objects is at least partially achieved by apparatuses and methods according to the patent claims.

The method for adapting a hearing device to the hearing needs and preferences of an individual, wherein sound processing in said hearing device is programmable by means of adjustable parameters, comprises the steps of a) presenting at least one auditory test signal to said individual;
b) capturing at least one image of at least a portion of said individual's body;
c) analyzing said at least one image;
d) deducing from a result of said image analysis whether or not said individual has shown a reaction upon said presenting said at least one auditory test signal and, if yes, which reaction said individual has shown;
e) determining, in dependence of said at least one auditory test signal and of said reaction or lack of reaction, a setting for at least one of said adjustable parameters.

This method is applicable to almost all people, irrespective of age.

In a particular aspect of the invention, the method is a method for automatically adapting a hearing device to the hearing needs and preferences of an individual.

As stated further above, the "adapting a hearing device to the hearing needs and preferences of an individual" is also referred to as "fitting". In hearing device fitting, it is frequently distinguished between a "first fit" or initial fitting, and "fine-tuning". The present invention is applicable to both.

In one embodiment, said auditory test signal is a signal for auditory perception (a signal to be auditorily perceived), more particularly, it is an acoustic test sound signal (i.e. sound waves). It is also possible, e.g., to provide electrical stimuli as auditory test signals, such as, e.g., in case of cochlea implants.

In one embodiment which may be combined with the before-addressed embodiment, the method comprises the step of j) applying said setting to said at least one adjustable parameter.

In one embodiment which may be combined with one or more of the before-addressed embodiments, the step c) is carried out in an automated fashion.

In one embodiment which may be combined with the before-addressed embodiment, the step b) is carried out in an automated fashion.

In one embodiment which may be combined with the before-addressed embodiment, the step a) is carried out in an automated fashion.

In one embodiment which may be combined with the before-addressed embodiment, the step e) is carried out in an automated fashion.

In one embodiment which may be combined with the before-addressed embodiment, the step j) is carried out in an automated fashion.

In one embodiment which may be combined with one or more of the before-addressed embodiments, said auditory test signal is an acoustic test signal.

In one embodiment which may be combined with one or more of the before-addressed embodiments, said at least one image is or comprises a digital image.

In one embodiment which may be combined with one or more of the before-addressed embodiments, said at least one image is or comprises a video recording, more particularly a digital video recording.

In one embodiment which may be combined with one or more of the before-addressed embodiments, said portion of said individual's body is said individual's face or a portion thereof.

In one embodiment which may be combined with one or more of the before-addressed embodiments, said reaction is an unintentional reaction, e.g., an uncontrolled reaction or a reflex reaction.

In one embodiment which may be combined with one or more of the before-addressed embodiments, said reaction is or comprises a change in the facial expression of said individual's face.

In one embodiment which may be combined with one or more of the before-addressed embodiments, said reaction is or comprises a change in diameter of at least one of said individual's pupils.

In one embodiment which may be combined with one or more of the before-addressed embodiments, said reaction is or comprises a movement of at least one of said individual's eyelids, in particular of at least one of said individual's lower eyelids.

In one embodiment which may be combined with one or more of the before-addressed embodiments, said at least one auditory test signal is or comprises speech.

In one embodiment referring to the before-addressed embodiment, the method comprises the step of f) giving an instruction to said individual in order to make said individual try to understand said speech in said at least one auditory test signal.

In one embodiment referring to the before-addressed embodiment, step f) is carried out before step a).

In one embodiment referring to one or both of the most recent addressed embodiments, the step f) is carried out in an automated fashion.

In one embodiment which may be combined with one or more of the before-addressed embodiments, the method comprises, between steps d) and e), the step of g) estimating from said reaction a quantity indicative of at least one of the group consisting of mental stress of said individual provoked by said at least one auditory test signal;

cognitive stress of said individual provoked by said at least one auditory test signal;

discomfort provoked in said individual by said at least one auditory test signal;

and said determining in step e) is carried out in dependence of said quantity. In particular, said quantity is not a binary measure (merely telling an existence or non-existence), but has a scale of several or many or substantially an infinite number of different possible values. Said cognitive stress can, e.g., originate from a hearing task the individual is requested to carry out, e.g., trying to understand hard-to-understand speech in noise. And said discomfort may originate from very loud signals or frightening sounds such as dog barking or thunder.

In one embodiment referring to the before-addressed embodiment, step g) is carried out in an automated fashion.

In one embodiment which may be combined with one or more of the before-addressed embodiments, the method comprises the steps of h) selecting, in dependence of said reaction, another at least one auditory test signal; and i) repeating steps a), b), c) and d) based on said other) at least one auditory test signal;

in particular, wherein step g) is carried out after step i), and wherein said determining is carried out also in dependence of said other at least one auditory test signal and of a reaction or lack of reaction said individual has shown upon said presenting said other at least one auditory test signal.

In one embodiment referring to the before-addressed embodiment, the step h) is carried out in an automated fashion.

In one embodiment referring to one or both of the most recent addressed embodiments, the step i) is carried out in an automated fashion.

In one embodiment which may be combined with one or more of the before-addressed embodiments, said hearing device is a hearing-aid device.

The use according to the invention is a use of one of the methods above for adapting a hearing device to the hearing needs and preferences of an individual being at least one of a mentally handicapped person, a person suffering from dementia, a baby, a child.

The apparatus for adapting a hearing device to the hearing needs and preferences of an individual, wherein sound processing in said hearing device is programmable by means of adjustable parameters, comprises a test signal generator structured and configured for presenting at least one auditory test signal to said individual;

an imaging apparatus structured and configured for capturing at least one image of at least a portion of said individual's body;

an analysis unit structured and configured for analyzing said at least one image and for deducing from a result of said image analysis whether or not said individual has shown a reaction upon said presenting said at least one auditory test signal and, if yes, which reaction said individual has shown;

a parameter setting unit structured and configured for determining, in dependence of said at least one auditory test signal and of said reaction or lack of reaction, a setting for at least one of said adjustable parameters.

In one embodiment, the apparatus comprises said hearing device.

In one embodiment which may be combined with the before-addressed embodiment, the apparatus comprises a storage unit comprising data indicative of dependencies between possible reactions of said individual and the way said individual perceived an auditory test signal, in particular wherein said way said individual perceived an auditory test signal concerns at least one of a loudness;

an intelligibility;

a degree of comfort or discomfort.

The invention comprises apparatuses with features of corresponding methods according to the invention, and vice versa.

The advantages of the apparatuses basically correspond to the advantages of corresponding methods and vice versa.

The computer program product comprises program code for causing a computer to perform the steps of C) analyzing at least one image of at least a portion of an individual's body upon presenting at least one auditory test signal to said individual;

D) deducing from said image analysis whether or not said individual has shown a reaction upon said presenting said at least one auditory test signal and, if yes, which reaction said individual has shown;

E) determining, in dependence of said at least one auditory test signal and of said reaction or lack of reaction, a setting for at least one adjustable parameter of a hearing device, wherein said at least one adjustable parameter is one of several adjustable parameters by means of which sound processing in said hearing device is programmable.

In one embodiment, said program code is configured to cause said computer to perform at least one of the following steps A) causing a presentation of said at least one auditory test signal to an individual;

B) causing the capture of said at least one image.

The invention comprises computer program products with features of corresponding methods or apparatuses according to the invention, and vice versa.

The advantages of the computer program products basically correspond to the advantages of corresponding methods and apparatuses, respectively, and vice versa.

The computer-readable medium comprises program code as described in the computer program products.

Further embodiments and advantages emerge from the dependent claims and the figures.

BRIEF DESCRIPTION OF THE DRAWINGS

Below, the invention is described in more detail by means of examples and the included drawing. The figure shows:

FIG. 1 a schematic illustration of an apparatus and a method according to the invention.

The reference symbols used in the figure and their meaning are summarized in the list of reference symbols. The described embodiments are meant as examples and shall not confine the invention.

DETAILED DESCRIPTION OF THE INVENTION

FIG. 1 shows a schematic illustration of an apparatus and a method according to the invention. The apparatus comprises a test signal generator 1, an imaging unit 2, an analysis unit 3, a parameter setting unit 4 and a storage unit 5, and it may comprise one or both hearing devices 6, 7 of an individual U, the hearing device user U. The hearing devices 6, 7, in particular the sound processing therein, is adjustable by means of adjustable parameters.

In order to adapt one or both hearing devices 6, 7 to the hearing needs and preferences of user U, i.e. to "fit" the hearing device(s) 6, 7, test signal generator 1 generates one or more test signals 1*a* to be auditorily perceived by user U. E.g., test signal generator 1 synthesizes, amplifies and outputs (via a loudspeaker) test tones, e.g., narrow-band signals, or present real-world sounds, in particular speech-containing sounds, wherein sampled sounds may be used.

During the presenting of the test signals 1*a*, or at least shortly after that, images 2*a* are taken by imaging unit 2, which show at least a portion of the user's body, in particular one or both eyes of user U. Preferably, the images are images of a video, i.e. a video is recorded.

In image analysis unit 3, the images are analyzed, so as to detect therein a reaction of user U. Image recognition software can be used here. In particular, unintentional reactions of user U shall be detected. E.g., a change in diameter of one or both of the user's pupils can be detected, or a movement of one or both lower eyelids. It is also possible, e.g., in case of very soft test signals 1*a*, that user U does not show any reaction upon the playing of the test signal, which is a valid result of the image analysis and also a valuable information for the fitting.

Now, it is possible to determine settings for one or more adjustable parameters of the hearing device(s) 6, 7, in particular for sound processing parameters, in dependence of the user's reaction (as determined in the image analysis) and of the presented test signal, and possibly also in dependence of the time relation between the presentation of the test signals and the image taking.

For facilitating and improving the determination of the parameter settings, in storage unit 5, data may be provided and used by parameter setting unit 4, which describe dependencies between possible reactions of said individual and the way said individual perceived an auditory test signal. For example, a certain way of changing the diameter of a pupil may be indicative of a certain degree of discomfort or stress. Considering the played test signal, it is possible to deduce from the reaction valuable information for adjusting parameters. E.g., if a test signal has been played to user U, which is assumed to be particularly loud, and user U thereupon showed certain indications of discomfort, there is a high probability that that test signal has been perceived as too loud.

Accordingly, it could be advisable to reduce a maximum output level of the hearing device accordingly, or to adjust a compression ratio for preventing the occurrence of too loud signals presented to user U, and/or to carry out other parameter adjustments.

Or, if user U has been asked to try to understand speech presented to him as a test signal or as a part thereof, and user U shows certain stress indications upon being presented these test signals, it is very likely that user U has problems to understand the presented speech, i.e. that there are intelligibility problems. Considering the properties of the presented test signal, new parameter settings can be found. E.g., if the speech was embedded in a lot of noise, parameters of a speech-in-noise program of the hearing device(s) 6, 7 can be adjusted, or if the speech was high-pitched speech without noise, parameters of a frequency shifter may be refined.

From the determined user reaction, one can also deduce information allowing to choose test sounds to presented to user U later on, for example thereby implementing an adaptive bracketing procedure as it is known from conventional automatic audiometry.

Usually, it will be preferable to sequentially present several test signals to user U. This way, settings for several parameters can be found, and rather reliable parameter settings can be found.

Moreover, it will usually be preferable to capture and analyze more than one details in the images 2*a*. E.g., one could analyze the user's facial expression (in particular considering the shape of the user's lips/mouth) and the pupil diameter for both eyes and movements of both lower eyelids and movements of both user's hands and arms. This way, the user's reaction can be detected and interpreted more reliably and more refinedly, distinguishing an increased number of different reactions, thus achieving more reliable parameter settings.

Note that it is possible to carry out the method, while user U is wearing the hearing device(s) 6, 7 (in particular for fine-tuning), but it is also possible to carry out the method at the user's unaided ears (in particular for accomplishing a first fit). And, moreover, it is possible to provide the test signals as sound waves in the room in which user U is located, but it is also possible to provide the hearing device(s) 6, 7 with corresponding audio signals (in a wireless or in a wirebound fashion), in particular with digital audio signals, while user U is wearing the hearing device(s) 6, 7, and let the hearing device(s) 6, 7 convert these into signal to be (auditorily) perceived by user U, in particular into acoustic sound.

For example, a fitting session or a portion thereof can be carried out as set forth in the following, wherein in this case, we assume that the user is using his hearing device(s) 6, 7:

The user (user 6) is instructed to look at a camera (imaging unit 2) and listen to sounds (test sounds 1*a*) which are going to be presented. If speech is presented, the user may be asked to repeat what has been spoken or may be incited to try to understand what has been spoken (for some other reason).

Then, the system (or apparatus) presents a test sound. Typically, the system will start with a presentation of test sounds which are estimated as not-challenging with respect to mental stress (audibility and discriminability of speech) and unpleasantness (loudness, extreme tonal imbalance). (In later steps, the estimated difficulty and unpleasantness of test sounds will be increased.)

The system checks, using image analysis unit 3 and parameter setting unit 4 and possibly also storage unit 5, if facial expression or width of pupillae indicate cognitive stress or sensual unpleasantness, the latter indicating hearing discomfort.

If cognitive stress or sensual unpleasantness is detected, the system will modify parameter settings of the sound processing in the hearing device(s) 6, 7 and repeat the presentation and analysis of facial parameters until the indicators of stress and/or discomfort disappear. Therein, it is to be noted that it would also be possible to continue with different test sounds while possibly leaving parameter settings unchanged.

If no cognitive stress and no sensual unpleasantness is detected, the system will select test sounds of a higher estimated difficulty and/or unpleasantness level and analyze the image 2*a* of the user's face with regard to indications of stress and discomfort and then optimize the parameter settings as far as required.

The procedure may be finished when neither on the mental stress reduction dimension nor on the discomfort reduction dimension, better settings with respect to stresslessness and comfort can be achieved by further attempts to optimize the parameter settings.

The invention allows to fit hearing devices to people who cannot reliably reply to questions or cannot be instructed or follow instructions.

The invention can lead to particularly good fitting results, because within relatively short time, many valuable responses of the user can be obtained. The invention can be carried out under more relaxed circumstances than in case of conventional fitting, since the individual does not or not as often have to consciously react to test signals, e.g., by forming and producing spoken responses. This allows to obtain more realistic results and/or to carry out the fitting procedure more refinedly and/or during a longer time (without overstraining the individual).

The invention can be carried out without a hearing device professional, and even by the user U alone, although presence and guidance by a hearing device professional, such as an audiologist, will usually be helpful and advisable. It is also possible to use the invention as a supporting and complementing constituent in hearing device fitting. For example, a hearing device professional may manually enter data indicative of, e.g., discomfort and mental stress, wherein these manually entered data are compared to automatically determined data for verification. It is also possible to confirm results of a conventional dialog-based fitting by comparison with concurrently automatedly obtained (computer-vision based) results.

It is possible to obtain audiograms using the invention, wherein the image-captured user reaction practically replaces the commonly used user's pressing of a button upon perceiving a test signal. Other, usually short test signals can be used, too. But a great advantage of the invention is that complex test signals can readily be used, in particular relatively long test signals and long sequences of test signals following in quite fast succession. Therein, test signal or test signal sequence lengths of more than half a minute or even in excess of one or even several minutes may be applied. Recording a video through such a long presentation allows to later on analyze the user's reactions and determine then, on a correspondingly strong data basis, quite reliable parameter settings. Or, a real-time analysis is carried out, which in addition allows to a real-time select or change the test sounds to be played (even in the same, long test sound sequence).

It is readily possible to carry out the invention in such a way that the correlation between the visually recorded user reaction and the test signal is very close, thus allowing to achieve useful and reliable results. This applies in particular, when unintentional physiological reactions are analysed and when the method is carried out in a suitable environment such as in a calm room, in particular a sound booth.

Aspects of the embodiments have been described in terms of functional units. As is readily understood, these functional units may be realized in virtually any number of hardware and/or software components adapted to performing the specified functions. For example, test signal generator 1, image analysis unit 3, parameter setting unit 4 and storage unit 5 may be realized in one and the same computer; in particular in a computer equipped with or connected to

- a sound-card, an amplifier and at least one loudspeaker;
- a camera and a video card providing a video signal input connector connected to the camera;
- a hearing device fitting interface device, such as NOAHlink™; and
- a hearing device fitting software package supporting features of the invention.

LIST OF REFERENCE SYMBOLS

1 test signal generator, tone generator
1*a* auditory test signal
2 imaging unit, camera, video camera
2*a* image, image or video of a portion of the user's body
3 analysis unit, image analysis unit, image recognition and evaluation software running on a computer system
4 parameter setting unit, evaluation unit, processor
5 storage unit, memory
6 hearing device
7 hearing device
U user

What is claimed is:

1. A method for adapting a hearing device to the hearing needs and preferences of an individual, wherein sound processing in said hearing device is programmable by means of adjustable parameters, said method comprising steps of:

a) presenting at least one auditory test signal to said individual via a test signal generator;

b) capturing at least one image of at least a portion of said individual's body via an imaging apparatus;

c) analyzing said at least one image via an analysis unit;

d) deducing, via the analysis unit, from a result of said image analysis whether or not said individual has shown a reaction upon said presenting said at least one auditory test signal and, if yes, which reaction said individual has shown;

e) determining, via a parameter setting unit, in dependence of said at least one auditory test signal and of a result of the analysis unit deducing from the result of said image analysis whether or not said individual has shown a reaction and, if yes, which reaction said individual has shown, a setting for at least one of said adjustable parameters.

2. The method according to claim 1, wherein said auditory test signal is an acoustic test sound signal.

3. The method according to claim 1, wherein said at least one image is or comprises a video recording.

4. The method according to claim 1, wherein said portion of said individual's body is said individual's face or a portion thereof.

5. The method according to claim 1, wherein said reaction is an unintentional reaction.

6. The method according to claim 1, wherein said reaction is or comprises a change in diameter of at least one of said individual's pupils.

7. The method according to claim 1, wherein said reaction is or comprises a movement of at least one of said individual's eyelids, in particular of at least one of said individual's lower eyelids.

8. The method according to claim 1, wherein said at least one auditory test signal is or comprises speech.

9. The method according to claim 8, further comprising a step of:

f) giving an instruction to said individual in order to make said individual try to understand said speech in said at least one auditory test signal.

10. The method according to claim 1 further comprising a step of:

g) estimating from said reaction a quantity indicative of at least one of a group consisting of:

mental stress of said individual provoked by said at least one auditory test signal;

cognitive stress of said individual provoked by said at least one auditory test signal;

discomfort provoked in said individual by said at least one auditory test signal;

and wherein said determining in step e) is carried out in dependence of said quantity.

11. The method according to claim 1, wherein step c) is carried out in an automated fashion.

12. The method according to claim 1, wherein steps d) and e) are carried out in an automated fashion.

13. The method according to claim 1, further comprising steps of:

h) selecting, in dependence of said reaction, another at least one auditory test signal; and i) repeating steps a), b), c) and d) based on said other at least one auditory test signal.

14. Use of a method according to claim 1 for adapting a hearing device to the hearing needs and preferences of an individual being at least one of a mentally handicapped person, a person suffering from dementia, a baby, and a child.

15. An apparatus for adapting a hearing device to the hearing needs and preferences of an individual, wherein sound processing in said hearing device is programmable by means of adjustable parameters, said apparatus comprising:

a test signal generator structured and configured for presenting at least one auditory test signal to said individual;

an imaging apparatus structured and configured for capturing at least one image of at least a portion of said individual's body;

an analysis unit structured and configured for analyzing said at least one image and for deducing from a result of said image analysis whether or not said individual has shown a reaction upon said presenting said at least one auditory test signal and, if yes, which reaction said individual has shown;

a parameter setting unit structured and configured for determining, in dependence of said at least one auditory test signal and of a result of the analysis unit deducing from the result of said image analysis whether or not said individual has shown a reaction and, if yes, which reaction said individual has shown, a setting for at least one of said adjustable parameters.

16. The apparatus according to claim 15, further comprising said hearing device.

17. The apparatus according to claim 15 or claim 16, further comprising a storage unit comprising data indicative of dependencies between possible reactions of said individual and a way said individual perceived an auditory test signal, wherein said way said individual perceived an auditory test signal concerns at least one of:

a loudness;

an intelligibility; and a degree of comfort or discomfort.

18. A non-transient computer-readable medium including contents that are configured to cause a computing system to perform steps of:

analyzing, via an analysis unit, at least one image of at least a portion of an individual's body upon presenting at least one auditory test signal to said individual;

deducing, via the analysis unit, from said image analysis whether or not said individual has shown a reaction upon said presenting said at least one auditory test signal and, if yes, which reaction said individual has shown;

determining, via a parameter setting unit, in dependence of said at least one auditory test signal and of a result of the analysis unit deducing from said image analysis whether or not said individual has shown a reaction and, if yes, which reaction said individual has shown, a setting for at least one adjustable parameter of a hearing device, wherein said at least one adjustable parameter is one of several adjustable parameters by means of which sound processing in said hearing device is programmable.

19. The computer-readable medium according to claim 18, wherein said steps further include:

causing a presentation of said at least one auditory test signal to an individual;

causing the capture of said at least one image.

20. The method of claim 1, wherein the test signal generator is located outside of the hearing device and the auditory test signal is presented to the individual via a microphone of the hearing device.

21. The method of claim 1 further comprising a step of:

(f) adjusting the hearing device based on the determined setting for the at least one of said adjustable parameters via the parameter setting unit.

22. The computer-readable medium according to claim 18, wherein said steps further include:

adjusting the hearing device based on the determined setting for the at least one of said adjustable parameters via the parameter setting unit.

* * * * *